US005800223A

United States Patent [19]

Iriono et al.

[11] Patent Number: 5,800,223

[45] Date of Patent: Sep. 1, 1998

[54] MARINE PROPULSION DEVICE

[75] Inventors: Yasushi Iriono; Yoshitsugu Sumino, both of Hamamatsu, Japan

[73] Assignee: Sanshin Kogyo Kabushiki Kaisha, Japan

[21] Appl. No.: 651,389

[22] Filed: May 22, 1996

[30] Foreign Application Priority Data

May 22, 1995 [JP] Japan ..... 7-122577

[51] Int. Cl.[6] ..... B63H 5/10

[52] U.S. Cl. ..... 440/49; 440/81; 416/128; 416/223 R

[58] Field of Search ..... 440/79, 80, 81, 440/82, 49; 416/128, 223 R

[56] References Cited

U.S. PATENT DOCUMENTS

| | | | |
|---|---|---|---|
| Re. 34,011 | 7/1992 | Brandt . | |
| 1,019,437 | 3/1912 | Draper . | |
| 1,455,591 | 5/1923 | Lawson . | |
| 1,639,785 | 8/1927 | Sepulveda . | |
| 1,813,552 | 7/1931 | Stechauner | 440/80 |
| 2,047,847 | 7/1936 | Ambjörnson . | |
| 3,312,286 | 4/1967 | Irgens . | |
| 3,697,193 | 10/1972 | Phillips . | |
| 4,073,601 | 2/1978 | Kress . | |
| 4,080,099 | 3/1978 | Snyder . | |
| 4,331,429 | 5/1982 | Koepsel et al. . | |
| 4,552,511 | 11/1985 | Sumigawa . | |
| 4,619,584 | 10/1986 | Brandt . | |
| 4,632,636 | 12/1986 | Smith . | |
| 4,802,822 | 2/1989 | Gilgenbach et al. . | |
| 5,249,995 | 10/1993 | Meisenburg et al. . | |
| 5,423,701 | 6/1995 | Rodskier et al. | 440/81 |

FOREIGN PATENT DOCUMENTS

| | | | |
|---|---|---|---|
| 61-268593 | 11/1986 | Japan . | |
| 392297 | 10/1932 | United Kingdom | 440/80 |
| 435993 | 10/1935 | United Kingdom . | |
| 2094894 | 9/1982 | United Kingdom | 440/81 |

OTHER PUBLICATIONS

Everything You Need to Know About Propellers, 3rd Edition, Mercury Marine, Brunswick Corp., 1984, Part No. 90–86144.

*Primary Examiner*—Stephen Avila

*Attorney, Agent, or Firm*—Knobbe, Martens, Olson & Bear, LLP

[57] ABSTRACT

A marine propulsion device improves the handling characteristics and the responsiveness of the watercraft on which it is used. The propulsion device includes a pair of counter-rotating propellers. At least the blades of the front propeller each have a mean camber line in cross-section which has a generally constant radius of curvature. This blade shape reduces cavitations and permits the rear propeller to be mounted closer to the front propeller, and consequently closer to the steering axis of the outboard drive. As a result, steering torque is reduced. The blades of the rear propeller also are not more than thirty percent smaller than the blades of the front propeller, and the average pitches of the propellers do not differ by more than one to four percent. These blade configurations of the front and rear propellers improve the stability of the watercraft when turning, thereby reducing chine walk, as well as improve the responsiveness of the watercraft.

39 Claims, 8 Drawing Sheets

MARINE PROPULSION DEVICE

BACKGROUND OF THE INVENTION

1. Field of the Invention

The present invention relates to a marine propulsion device, and more particularly to a blade design for a marine propulsion device.

2. Description of Related Art

Many outboard and stern drives now employ a counter-rotating propeller system. The propeller system includes a pair of propellers arranged in series. The propellers are of opposite hand and rotate in opposite directions to produce a forward driving thrust. The blades of the rear propeller commonly are one-third to two-thirds smaller than the front propeller blades. As a result of the different propeller sizes, a gap typically exists between the front and rear propellers.

Several drawbacks, however, are associated with marine drives employing prior counter-rotating propeller systems, especially when used in connection with a light-weight, high-speed boat, such as a bass fishing boat. The outboard motor on such boat is commonly mounted high to run the propellers partially surfaced. However, with this mounting arrangement, excessive slipping of the rear propeller often occurs. The smaller rear propeller frequently slips due to cavitations generated by the significantly-larger front propeller when surfacing (i.e., ventilating above the water surface). This problem becomes more acute when turning, with the rear propeller being largely exposed to air. The rear propeller produces less thrust, and the watercraft consequently becomes more difficult to handle and less stable.

Some prior counter-rotating propeller systems have increased the spacing between the front and rear propellers, beyond the normal gap mentioned above, in order to reduce the affect of the cavitations caused by the front propeller. The increased spacing, however, produces noticeable steering torques on the watercraft.

The rear propeller in many prior counter-rotating dual propeller systems tends to pull the watercraft to one side. The surfacing rear propeller tries to walk across the water as its passes through its arc path above the water. This action simulates a paddle wheel. The resulting forces pull the outboard motor in one direction around its steering axis (i.e., steering center). The increased spacing between the front and rear propellers exacerbates this effect as the rear propeller lies further from the steering axis. The boat driver thus experiences heavy steering torque which he or she must compensate for at all times to hold the watercraft in a straight line.

Prior watercraft employing a counter-rotating dual propeller system also are susceptible to "chine walking," especially at planing speeds. That is, the watercraft tends to skid or slide outwardly to some degree in its turns when turning at high speeds. This adds "play" to the steering of the watercraft which reduces the handling characteristics and responsiveness of the watercraft.

SUMMARY OF THE INVENTION

A need therefore exists for a propulsion device which improves the responsiveness and handling characteristics of the watercraft on which it is used.

One aspect of the present invention involves a propulsion device for a watercraft. The propulsion device includes a front propeller and a rear propeller which are intended to rotate in opposite directions about a common rotational axis. The front and rear propellers each include at least one blade and have a total blade face surface area. The total blade face surface area of the rear propeller is smaller than the total blade face surface area of the front propeller, but no smaller than about 70% of the total blade face surface area of the front propeller. These relative blade sizes improve the stability of the watercraft when turning.

In accordance with another aspect of the present invention, a propulsion device for a watercraft comprises at least one propeller blade having a leading edge and a trailing edge. A blade face and a blade back extend between the leading and trailing edges on opposite sides of the propeller blade. The blade includes a mean camber line defined through a blade section taken along a pitch line of the blade. The mean camber line has a generally constant radius of curvature between the leading and trailing edges of the blade.

This blade shape reduces cavitations. Thus, when the front propeller includes such a blade design, the rear propeller can be mounted closer to the front propeller, and consequently closer to the steering axis of the outboard drive. As a result, steering torque is reduced.

An additional aspect of the present invention involves a propulsion device for a watercraft. The propulsion device includes a front propeller and a rear propeller which are intended to rotate in opposite directions about a common rotational axis. The front and rear propellers each include at least one blade which has an average pitch along a pitch line taken at a 7/10 radius of the blade. The average pitches of the front and rear propellers at the 7/10 radius differ from each other by not more than generally about 4 percent. This difference in average pitches between the blades of the front and rear propellers reduces chine walking and substantially eliminates steering play.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF THE PREFERRED EMBODIMENTS

Figure 1:
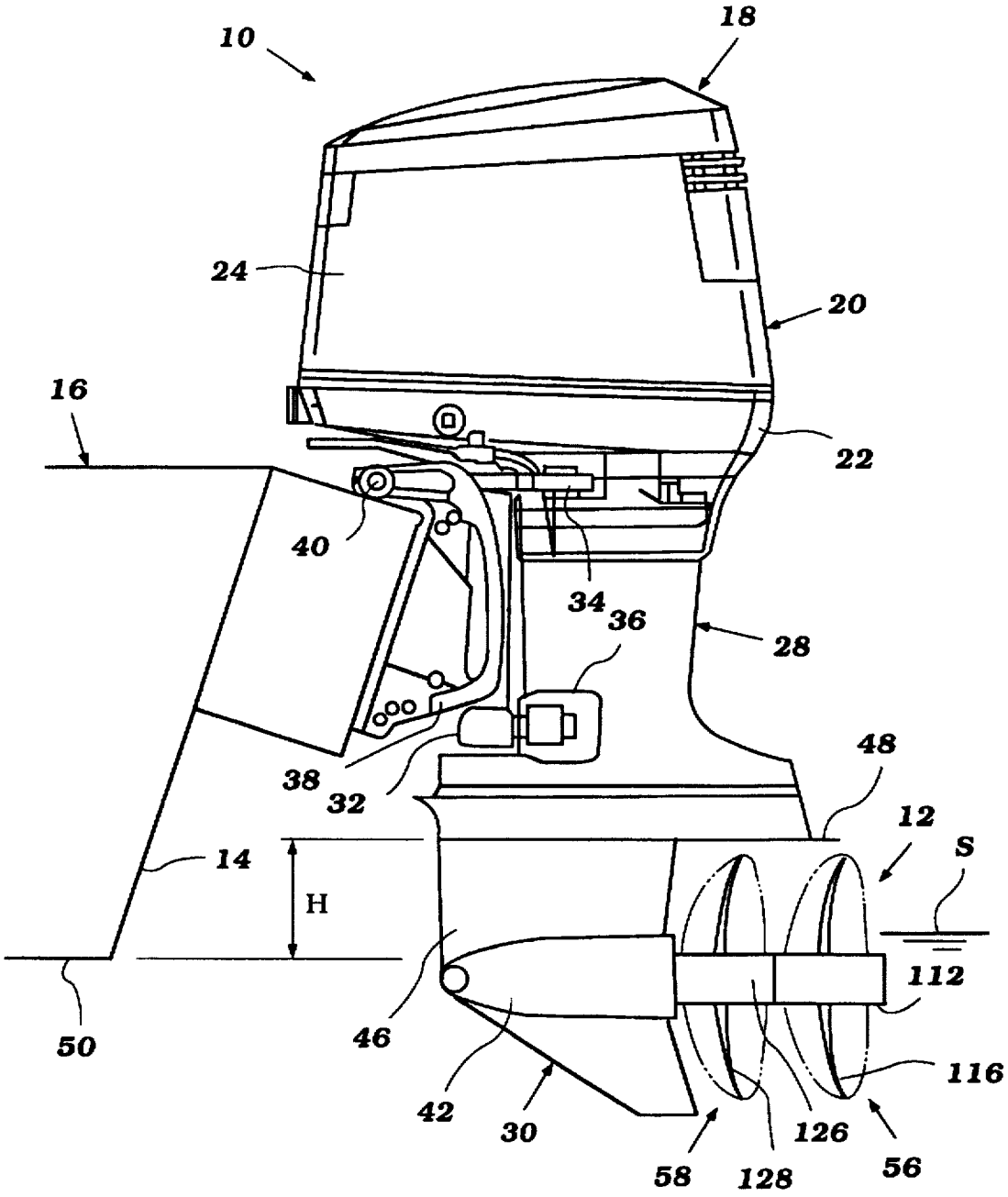
FIG. 1 is a side elevational view of an outboard drive which embodies a propulsion device in accordance with a preferred embodiment of the present invention.

FIG. 1 illustrates a marine outboard drive 10 which incorporates a propulsion device 12 that is configured in accordance with a preferred embodiment of the present invention. In the illustrated embodiment, the outboard drive 10 is depicted as an outboard motor for mounting on a transom 14 of a watercraft 16. It is contemplated, however, that those skilled in the art will readily appreciate that the present invention can be applied to stern drive units of inboard-outboard motors and to other types of watercraft drive units as well.

In the illustrated embodiment, the outboard drive 10 has a power head 18 which includes an engine (not shown). A conventional protective cowling 20 surrounds the engine. The cowling 20 desirably includes a lower tray 22 and a top cowling member 24. These components 22, 24 of the protective cowling 20 together define an engine compartment which houses the engine.

The engine is mounted conventionally with its output shaft (i.e., crankshaft) rotating about a generally vertical axis. The crankshaft (not shown) drives a drive shaft 26 (see FIG. 2) , as known in the art. The drive shaft 26 depends from the power head 18 of the outboard drive 10.

A drive shaft housing 28 extends downward from the lower tray 20 and terminates in a lower unit 30. As understood from FIG. 2, the drive shaft 26 extends through and is journaled within the drive shaft housing 28.

A steering shaft assembly 32 is affixed to the drive shaft housing 28 by upper and lower brackets 34, 36. The brackets 34, 36 support the shaft 32 for steering movement. Steering movement occurs about a generally vertical steering axis which extends through the steering shaft 32. A steering arm (not shown) which is connected to an upper end of the steering shaft can extend in a forward direction for manual steering of the outboard drive 10, as known in the art.

The steering shaft assembly 36 also is pivotably connected to a clamping bracket 38 by a pin 40. The clamping bracket 38, in turn, is configured to be attached to the transom 14 of the watercraft 16. This conventional coupling permits the outboard drive 10 to be pivoted relative to the pin 40 to permit adjustment of the trim position of the outboard drive 10 and for tilt-up of the outboard drive 10.

Although not illustrated, it is understood that a conventional hydraulic tilt and trim cylinder assembly, as well as a conventional hydraulic steering cylinder assembly can be used as well with the present outboard drive 10. The construction of the steering and trim mechanism is considered to be conventional and, for that reason, further description is not believed necessary for appreciation and understanding of the present invention.

Figure 2:
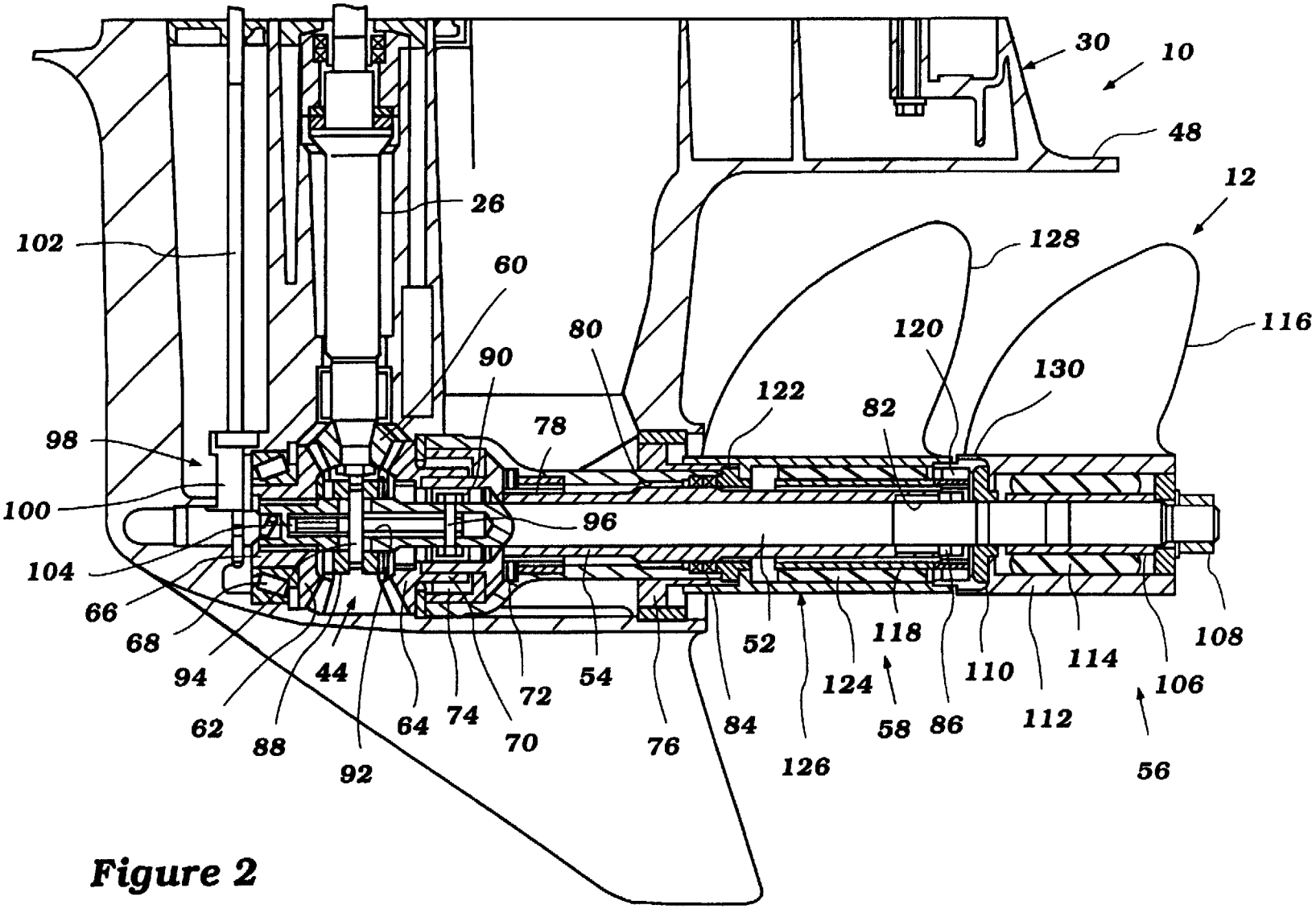
FIG. 2 is a sectional side elevational view of a lower unit and propulsion device of the outboard drive of FIG. 1.

The lower unit 30 includes a nacelle 42 which houses a transmission 44 (see FIG. 2). A strut 46 suspends the nacelle 42 beneath an upper cavitation plate 48. The cavitation plate 48 extends over the nacelle 42 and beyond a rear end of the nacelle 42 to cover at least a portion of the propulsion device 12. As seen in FIG. 1, the outboard drive 10 desirably is positioned on the watercraft transom 14 such that the captivation plate 48 resides at a height H above a bottom of the watercraft hull 50 near the transom 14. In this high-mount position, the outboard drive 10 is positioned such that the propulsion device 12 pierce through the water surface S of the body of water in which the watercraft is operated when the watercraft 16 is up on plane. In the illustrated embodiment, the mount position of the outboard drive 10 on the transom 14 locates the rotational axis of the propulsion device 12 beneath the water surface S when the watercraft 16 is planing.

As illustrated in FIG. 2, the drive shaft 26 extends from the drive shaft housing 28 into the lower unit 30 where the transmission 44 selectively couples the drive shaft 26 to an inner propulsion shaft 52 and to an outer propulsion shaft 54. The transmission 44 advantageously is a forward/neutral/reverse-type transmission. In this manner, the drive shaft 26 drives the inner and outer propulsion shafts 52, 54 (which rotate in a first direction and in a second counter direction, respectively) in any of these operational states, as described below in detail.

The propulsion shafts 52, 54 drive the propulsion device 12. The propulsion device 12 is a counter-rotating propeller device that includes a rear propeller 56 designed to spin in one direction and to assert a forward thrust, and a front propeller 58 designed to spin in the opposite direction and to assert a forward thrust. The counter-rotational propulsion device 12 will be explained in detail below.

The drive shaft 26 carries a drive gear 60 at its lower end, which is disposed within the lower unit 30 and which forms a portion of the transmission 60. The drive gear 44 preferably is a bevel type gear.

The transmission 44 also includes a pair of counter-rotating driven gears 62, 64 that are in mesh engagement with the drive gear 60. The pair of driven gears 62, 64 preferably are positioned on diametrically opposite sides of the drive gear 60, and are suitably journaled within the lower unit 30, as described below. Each driven gear 62, 64 is positioned at about a 90° shaft angle with the drive gear 60. That is, the propulsion shafts 52, 54 and the drive shaft 26, desirably intersect at about a 90° shaft angle; however, it is contemplated that the drive shaft 26 and the propulsion shafts 52, 54 can intersect at almost any angle.

In the illustrated embodiment, the pair of driven gears 62, 64 are a front bevel gear 62 and an opposing rear bevel gear 64. The front gear 62 includes a hub 66 which is journaled within the lower unit 30 by a front thrust bearing 68. The front thrust bearing 68 rotatably supports the front gear 62 in mesh engagement with the drive gear 60. The hub 66 has a central bore through which the inner propulsion shaft 52 passes when assembled. The inner propulsion shaft 52 is suitably journaled within the central bore of the front gear hub 66. The front gear 62 also includes a series of teeth formed on an annular front facing engagement surface. The teeth positively engage a portion of a clutch of the transmission 44, as discussed below.

As seen in FIG. 2, the rear gear 64 also includes a hub 70 which is suitably journaled within a bearing casing 72 located within the lower unit 30 by a rear thrust bearing 74. The rear thrust bearing 74 rotatably supports the rear gear 64 in mesh engagement with the drive gear 60. A front end ring 76, attached to the lower unit 30, secures the bearing casing 72 to the lower unit 30.

The hub 70 of the rear gear 64 has a central bore through which the inner propulsion shaft 52 and the outer propulsion shaft 54 pass when assembled. The rear gear 64 also includes an annular front engagement surface and an annular rear engagement surface. Each engagement surface carries a series of teeth for positive engagement with a clutch of the transmission 44, as discussed below.

The inner propulsion shaft 52 and the hollow outer propulsion shaft 54 are disposed within the lower unit 30. The bearing casing 72 rotatably supports the outer propulsion shaft 54. A front needle bearing assembly 78 journals a front end of the outer propulsion shaft 54 within the bearing casing 76. A needle bearing assembly 80 supports the outer propulsion shaft 54 within the bearing casing 60 at an opposite end of the bearing casing 60 from the front bearing assembly 78.

As seen in FIG. 2, the inner propulsion shaft 52, as noted above, extends through front gear hub 66 and the rear gear hub 70, and is suitably journaled therein. On the rear side of the rear gear 64, the inner shaft 52 extends through the outer shaft 54 and is suitably journaled therein by a needle bearing 82 which supports the inner shaft 52 at the rear end of the outer shaft 54.

A first pair of seals 84 (e.g., oil seals) are interposed between the bearing casing 72 and outer propulsion shaft 54 at the rear end of the bearing casing 72. Likewise, a second pair of seals 86 (e.g., oil seals) are interposed between the inner shaft 52 and the outer shaft 54 at the rear end of the outer shaft 54. Lubricant within a lubricant sump flows through the gaps between the bearing casing 72 and the outer shaft 54, and between the outer shaft 54 and the inner shaft 52 to lubricate the bearings 78, 80, 82 supporting the inner propulsion shaft 52 and the outer propulsion shaft 54. The seals 84, 86, located at the rear ends of the bearing casing 72 and of the outer shaft 54, substantially prevent lubricant flow beyond these points.

The front end of the inner propulsion shaft 52 includes a longitudinal bore. The bore stems from the front end of the inner shaft 52 to a bottom surface which is positioned on the rear side of the axis of the drive shaft 26. A front aperture extends through the inner shaft 52, transverse to the axis of the longitudinal bore, at a position forward of the front bevel gear 62. The inner shaft 52 also includes a rear aperture that extends transverse to the axis of the longitudinal bore and is generally symmetrically positioned between the front bevel gear 62 and the rear bevel gear 64.

Figure 3:
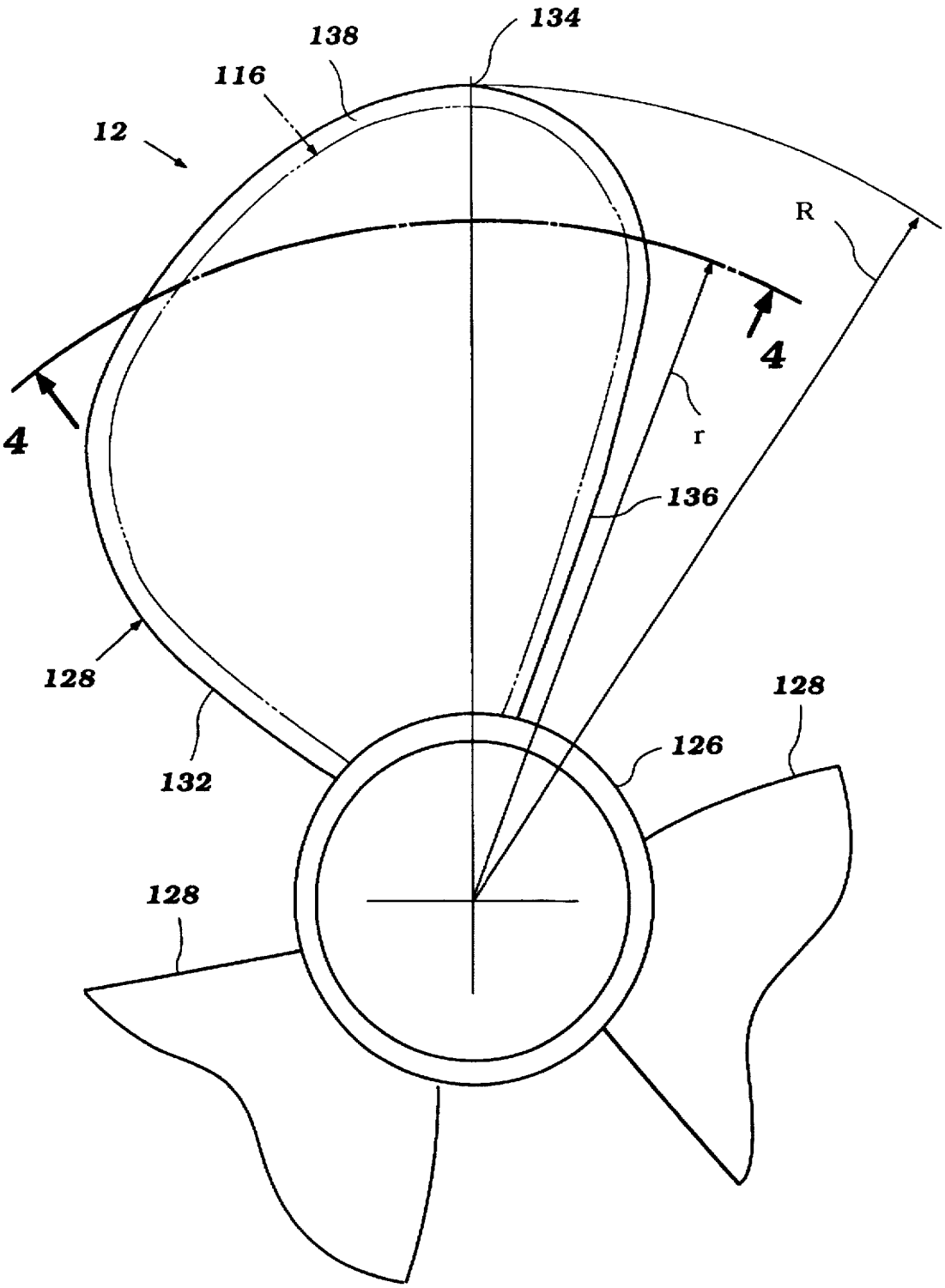
FIG. 3 is a partial front plan view of a front propeller of the propulsion device of FIG. 2 with a blade of the rear propeller illustrated in phantom line.

As best seen in FIG. 3, the transmission 44 also includes a front dog clutch 88 and a rear dog clutch 90 coupled to a plunger 92. As discussed in detail below, the front dog clutch 88 selectively couples the inner propulsion shaft 52 either to the front gear 62 or to the rear gear 64. The rear dog clutch 90 selectively couples the outer propulsion shaft 54 to the rear gear 64. FIG. 2 illustrates the front dog clutch 88 and the rear dog clutch 90 set in a neutral position (i.e., in a position in which the clutches 88, 90 do not engage either the front gear 62 or the rear gear 64).

The plunger 92 has a generally cylindrical rod shape and slides within the longitudinal bore of the inner shaft 52 to actuate the clutches 88, 90. The plunger 92 may be solid; however, it is preferred that the plunger 92 be hollow (i.e., a cylindrical tube), especially where a neutral detent mechanism of the type described below is used.

The plunger 92 includes a front hole that is positioned generally transverse to the longitudinal axis of the plunger 92, and a rear hole that is likewise positioned generally transverse to the longitudinal axis of the plunger 92. Each hole desirably is located symmetrically in relation to the corresponding apertures of the inner propulsion shaft 52.

As seen in FIG. 2, the front dog clutch 88 has a generally spool-like shape and includes an axial bore which extends between a flat annular front end and a flat annular rear end. The front and rear ends of the clutch 88 extend generally transverse to the longitudinal axis of the clutch 88. The bore is sized to receive the inner propulsion shaft 52.

The front surface of the front dog clutch 88 is substantially coextensive in area with the annular engagement surface of the front gear 62. Teeth extend from the clutch front and rear surfaces in the longitudinal direction and desirably correspond to the respective teeth of the engagement surfaces of the front and rear gears 62, 64, both in size (e.g., axial length) and in configuration.

The front dog clutch 88 includes a spline connection to the inner propulsion shaft 52. Internal splines of the front dog clutch matingly engage external splines on the external surface of the inner drive shaft 52. This spline connection provides a driving connection between the front clutch 88 and the inner propulsion shaft 52, and permits the front clutch 88 to slide over the inner propulsion shaft 52.

The front dog clutch 88 also includes a hole that extends through the midsection of the clutch 88 in a direction generally transverse to the longitudinal axis of the clutch 88. The hole is sized to receive a pin 94, which, when passed through the front aperture of the inner propulsion shaft 52 and through front hole of the plunger 92, interconnects the plunger 92 and the front dog clutch 88, with a portion of the inner shaft 52 interposed therebetween. The pin 94 may be held in place by a press-fit connection between the pin 94 and the front hole of the plunger 92, or by a conventional coil spring (not shown) which is contained within a groove about the front dog clutch 88.

As also seen in FIG. 2, the rear dog clutch 90 generally has a tubular shape and includes an axial bore which extends between a flat annular front end surface and an annular rear end surface. The bore is sized to receive the outer propulsion shaft 54.

The front annular end plate of the rear clutch 90 is substantially coextensive in size with the annular engagement surface of the rear gear 64. Teeth extend from the end surface of the rear clutch 90 and desirably correspond to the teeth of the rear gear 64, both in size (e.g., axial length) and in configuration.

The rear dog clutch 90 has a spline connection to the outer propulsion shaft 54, which establishes a drive connection between the rear clutch 90 and the shaft 54, yet permits the clutch 90 to slide along the axis of the shaft 54. The rear dog clutch 90 specifically includes internal splines within the bore that mate with corresponding external splines on the outer periphery of the outer propulsion shaft 54.

The rear dog clutch 90 also includes an internal annular groove. The internal groove is sized to receive a pin 96 which extends through the rear aperture of the inner propulsion shaft 52 and through the rear hole of the plunger 92 when assembled. Roller bearings journal the pin 96 within the internal groove of the rear dog clutch 90, as known in the art. In this manner, the rear clutch 90 is rotatably coupled to the plunger 92, while drivingly connected to the outer propeller shaft 54.

The pin 96 is inserted into the internal annular groove through an aperture (not shown) in the rear dog clutch 90. When assembled, the pin 96 is passed through the aperture and is inserted between the roller bearings in the groove, through the rear aperture of the inner propulsion shaft 52 and through the rear hole of the plunger 92. The pin 96 may be held in place by a press-fit connection between the pin 96 and the plunger 92, or by other conventional means.

With reference to FIG. 2, an actuator mechanism 98 moves the plunger 92 of the clutch assembly from a position in which the front and rear dog clutches 88, 90 engage the first and second gears 52, 54, respectively, through a position of nonengagement (i.e., the neutral position), and to a position in which the front dog clutch 88 engages the rear gear 64. The actuator mechanism 98 positively reciprocates the plunger 92 between these positions.

As seen in FIG. 2, the actuator mechanism 98 includes a cam member 100 which connects the plunger 92 to a rotatable shift rod 102. In the illustrated embodiment, the shift rod 102 depends in the vertical direction through the drive shaft housing 28 and into the lower unit 30. The actuator mechanism 98 also includes a remote gear shifter, which is mounted conventionally proximate to the steering controls (not shown) of the watercraft 16. The gear shifter includes a shift lever which is coupled to a conventional shift slider via a bowden wire cable. The shift slider connects to a lever arm, which in turn connects to one end of a link. An opposite end of the link is fixed to the shift rod 102 so as to move the cam member 100 of the actuator mechanism 98 in response to movement of the shift lever, as known in the art. In this manner, the actuator 98 controls the transmission 44.

In the illustrated embodiment, the cam member 100 converts rotational movement of the shift rod 102 into linear movement of the plunger 92 to move the plunger 92 and the clutches 88, 90 generally along the axis of the propulsion shafts 52, 54. The cam member 100 is affixed to a lower end of the shift rod 102.

The transmission 44 additionally may include a neutral detent mechanism 104 to hold the plunger 92 (and the coupled clutches 88, 90) in the neutral position. FIG. 2 illustrates an embodiment of a neutral detent mechanism 104 used with the hollow plunger 92 in which the detent mechanism 104 cooperates between the plunger 92 and the inner propulsion shaft 52. The neutral detent mechanism 104 desirably is configured in accordance with the disclosure of U.S. Pat. No. 4,570,776, entitled "Detent Mechanism for Clutches," issued Feb. 18, 1986, and assigned to the assignee hereof, which is hereby incorporated by reference. Because the detent mechanism 104 is believed to be conventional, further description of the detent mechanism 104 is thought unnecessary for an understanding of the present invention.

As noted above, the propeller shafts 52, 54, when coupled to the drive shaft 26 by the transmission 44, drive the propulsion device 12. The propulsion device 12 will now be described principally in reference to FIGS. 2–6.

As seen in FIG. 2, the inner shaft 52 extends beyond the rear end of the outer shaft 54. The rear end of the inner shaft 52 carries an engagement sleeve 106 of the rear propeller 56. The engagement sleeve 106 has a spline connection with the rear end of the inner shaft 52. The sleeve 106 is fixed to the inner shaft rear end between a nut 108 threaded on the rear end of the shaft 52 and an annular thrust washer 110 that engages the inner shaft 52 proximate to the rear end of the outer shaft 54.

The inner shaft 52 also carries a rear propeller boss 112. An elastic bushing 114 is interposed between the engagement sleeve 106 and the propeller boss 112 and is compressed therebetween. The bushing 114 is secured to the engagement sleeve 106 by a heat process known in the art. The frictional engagement between the boss 112, the elastic bushing 114, and the engagement sleeve 106 is sufficient to transmit rotational forces from the sleeve 106, driven by the inner propulsion shaft 52, to propeller blades 116 attached to the propeller boss 112.

The outer shaft 54 carries the front propeller 58 in a similar fashion. As best seen in FIG. 2, the rear end portion of the outer shaft 54 carries a second engagement sleeve 118 in driving engagement thereabout by a spline connection. The second engagement sleeve 118 is secured onto the outer shaft 54 between a retaining ring 120 and a second annular thrust washer 122.

A second annular elastic bushing 124 surrounds the second engagement sleeve 118. The bushing 124 is secured to the sleeve 118 by a heat process known in the art.

A front propeller boss 126 surrounds the elastic bushing 118, which is held under pressure between the boss 126 and the sleeve 118 in frictional engagement. The frictional engagement between the propeller boss 126 and the bushing 118 is sufficient to transmit a rotational force from the sleeve 118 to blades 128 of the front propeller 58 attached to the front propeller boss 126.

As seen in FIG. 2, a rear end of the second boss 126 and a front end of the first boss 112 generally lie adjacent to each other so as to generally enclose the rear end of the outer propulsion shaft 54, the retainer ring 120, and the first thrust flange 110.

In the illustrated embodiment, the first boss 112 includes an annular lip 130 at the front end on the exterior surface of the boss 112. The lip 130 extends about the front thrust washer 110 and a portion of the retaining ring 120.

The blades 116, 128 of the rear and front propellers 56, 58 desirably are configured to improve the handling characteristics and responsiveness of the watercraft 16 on which the present propulsion device 12 is used. The configurations of the front and rear propeller blades 116, 128 will be described principally in reference to FIGS. 3–6.

With reference to FIG. 3, the front propeller desirably includes a plurality of propeller blades, although a single blade can be used. In the illustrated embodiment, the front propeller 58 includes three blades 128 to optimize vibration, size, efficiency and cost, as known in the art. Each blade 128 desirably has the same shape and size.

The blade 128 has a leading edge 132 that extends from the sleeve of the boss 126 to a blade tip 134. The blade tip 134 is the maximum reach of the blade 128 from the center of the propeller boss 126. The leading edge 132 lies on the side edge of the blade 128 which first cuts through the water and which lies closest to the lower unit 30.

The blade 128 also includes a trailing edge 136. The trailing edge 136 is that part of the blade that lies furthest from the lower unit 30 and from which the water leaves the blade 128. The trailing edge 136 also extends from the sleeve of the boss 126 to the blade tip 134.

Figure 4:
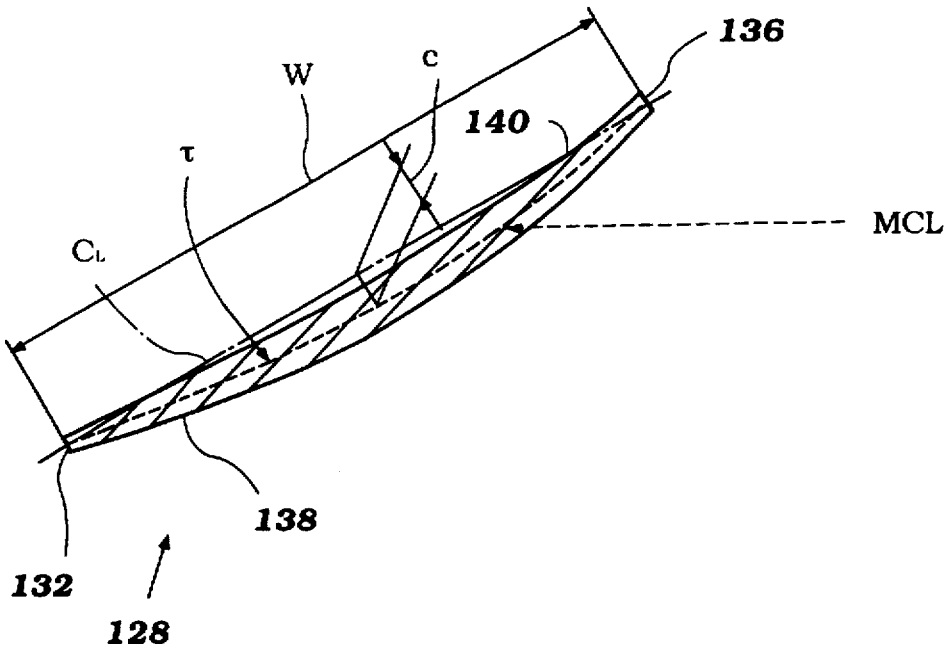
FIG. 4 is a cross-sectional view of a blade of the propeller of FIG. 3 at a 7/10 radius.

With reference to FIGS. 3 and 4, a blade back 138 extends between the leading and trailing edges 132, 136 on a side of the blade 128 closest to the lower unit 30. The surface of the blade back 138 generally has a convex shape, as seen in FIG. 4.

A blade face 140 extends between the leading and trailing edges 132, 136 on the opposite side of the blade 128, i.e., on the side furthest from the lower unit 30. The blade face 140 functions as the positive pressure side of the blade 128, while the blade back 138 functions as the negative pressure side, as known in the art.

The shapes of the blade face 140 and the blade back 138 are best understood by examining a blade section or cutaway taken along a particular pitch line (indicated as line 4—4 in FIG. 3). As is conventional, the shape of the blade 128 will be discussed at a radius r which is 7/10 of overall radius R (i.e., 70% of the distance from the propellers center of rotation to the blade tip). The radius r at this pitch line is commonly referred to as the 7/10 radius. The section at the 7/10 radius most typically represents the entire blade 128, as known in the art.

FIG. 4 illustrates a section of the blade 128 taken along the pitch line at the 7/10 radius (see FIG. 3). The blade face 140 has a generally concave shape, while the blade back 138 has a corresponding convex shape. The blade thickness increases from the edges 132, 136 of the blade 128 toward the center of the blade 128. The maximum thickness of the blade occurs at a mid-point between the leading and trailing edges 132, 136.

The blade 128 has a width W measured as the straight distance between the leading and trailing edges 132, 136. A chord line CL extends between the leading and trailing edges 132, 136, as seen in FIG. 4. A major design feature of the blade 128 is the mean camber line MCL, which is the locus of points halfway between the blade face 140 and the blade back 138 as measured perpendicular to the mean camber line MCL itself.

As seen in FIG. 4, the mean camber line MCL of the present blade section has an arcuate shape. In the illustrated embodiment, the mean camber line MCL is shaped in a circular arc having a constant radius of curvature $\tau$.

The camber C of the blade 128 is defined between the mean camber line MCL and the chord line CL. The blade camber is the maximum distance between the mean camber line MCL and the chord line CL measured perpendicular to the chord line CL. The blade camber C desirably is no smaller than about 0.5% of the blade width W. That is, the camber amount of the blade can be expressed as:

$$\text{Camber Amount } (\%) = C/W \times 100$$

with the camber amount being generally equal to or greater than 0.5%. The blade camber C, however, desirably is not larger than about 3.5 percent of the blade width W. This blade configuration improves anti-cavitation, as will be described below.

Figure 5:
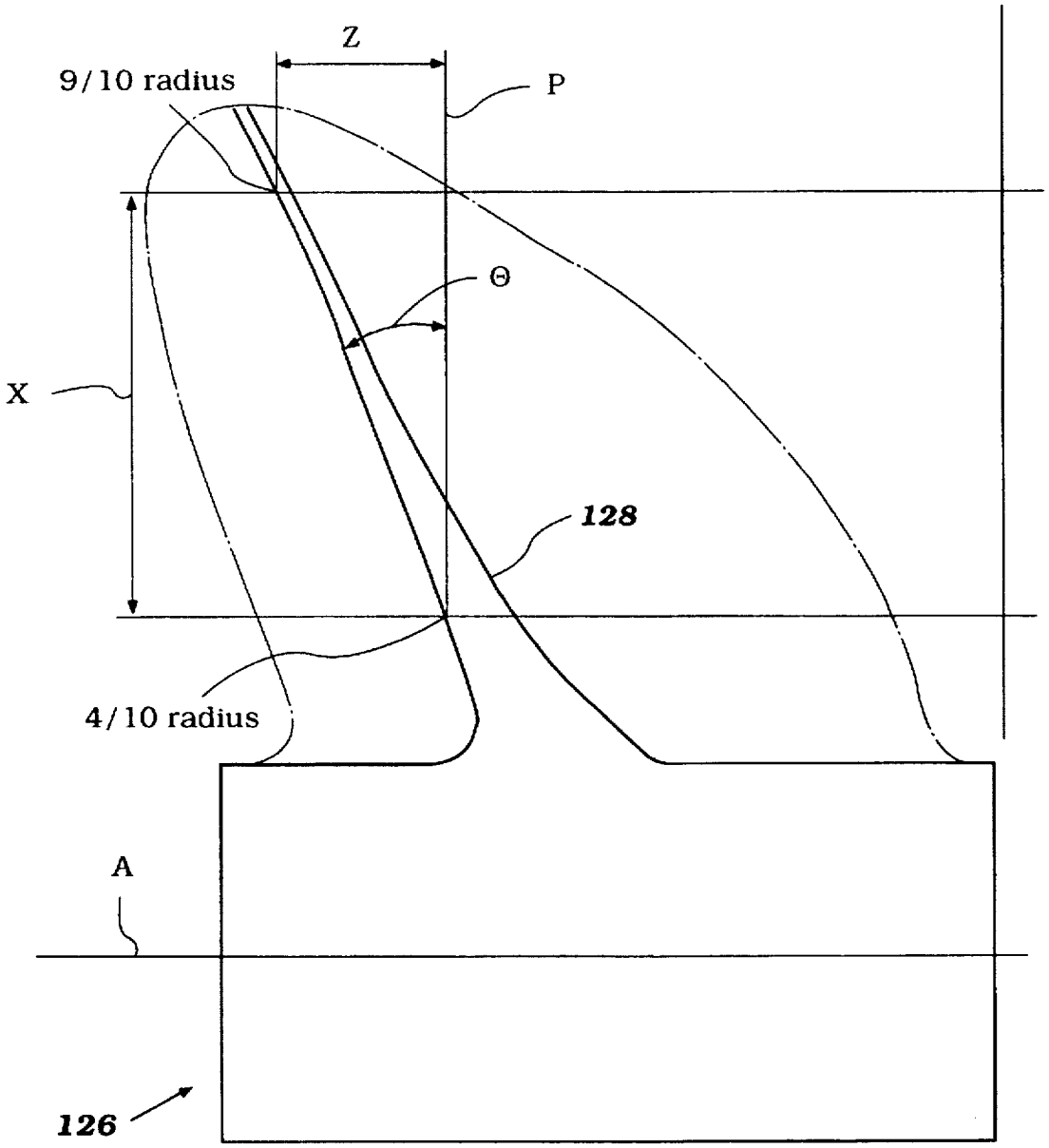
FIG. 5 is a schematic, cross-sectional side elevational view of a blade of the front propeller of FIG. 3.

FIG. 5 illustrates the blade rake $\theta$ of the blades 128 of the front propeller 58. The blade rake $\theta$ is the angle between the blade face 140 and a plane P which lies transverse to the rotational axis A of the propeller 58. In the illustrated embodiment, the rake angle $\theta$ is determined for a middle section of the blade 128 omitting the blade tip 134 and the portion of the blade 128 near the propeller boss 126. The radial dimension X represents a radial distance between the 4/10 radius and the 9/10 radius of the blade. The slant-back dimension Z represents a distance measured in the axial direction between a point of the blade face 140 at the 4/10 radius and a point of the blade face 140 at the 9/10 radius. The radial dimension X and the slant-back dimension Z are used to calculate blade rake as follows:

$$\text{Rake Angle } \theta = \text{Tan}^{-1} Z/X$$

In the illustrated embodiment, the rake angle $\theta$ desirably lies within the range from about 15° to about 25°, and more preferably equals about 20°. An increased rake angle $\theta$ helps lift the watercraft bow to minimize the contact surface between the watercraft hull 50 and the water and to thereby reduces resistance on the hull 50. The top speed of the watercraft 16 consequently increases.

The rear propeller 56 desirably includes the same number of propeller blades 116 as the front propeller 58. In the illustrated embodiment, the rear propeller 56 includes three blades 116; however, the present invention can be practice with other number of blades.

The shape of the blades 116 desirably is generally similar to that of the front propeller blades 128. The rear propeller blades 116 include a mean camber line MCL of a generally constant radius of curvature with a camber C ranging between about 0.5 percent and about 3.5 percent of the width W of the blade 116. The blades 116 also have a rake angle $\theta$ within the range from about 15° to 25°. The size of the rear propeller blades 116 and the pitch of the blades 116, however, differ from that of the front propeller blades 128.

As seen in FIG. 3, the rear propeller blade 116 desirably is slightly smaller than the front propeller blade 128. The size difference is best articulated by comparing the total surface area of the blade front faces of the front and rear propellers 58, 56 (i.e., comparing the total blade face surface area of the rear propeller 116 with the total blade face surface area of the front propeller 128). The total blade face surface area of the rear propeller 116 desirably is no smaller than about seventy percent (70%) of the total blade face surface area of the front propeller 128. The larger blade face surface of the rear propeller 116, as compared with conventional rear propellers which are much smaller (e.g., one to two-thirds the size of the front propeller), substantially reduces blade slipping and improves the handling stability of the watercraft 16 when turning, while still obtaining many of the advantages realized by a smaller rear propeller.

The diameter size of the front and rear propellers 58, 56 desirably are selected in accordance with the torque delivered by the corresponding propeller shaft, the desired efficiency of the propulsion device, and the desired top speed of the watercraft 16, as known in the art. The diameter of the propeller is the distance across the circle made by the blade tips as the propeller rotates. In other words, the diameter is twice the overall radius R of the blade from the rotational axis of the propeller to blade tip 134.

Figure 6:
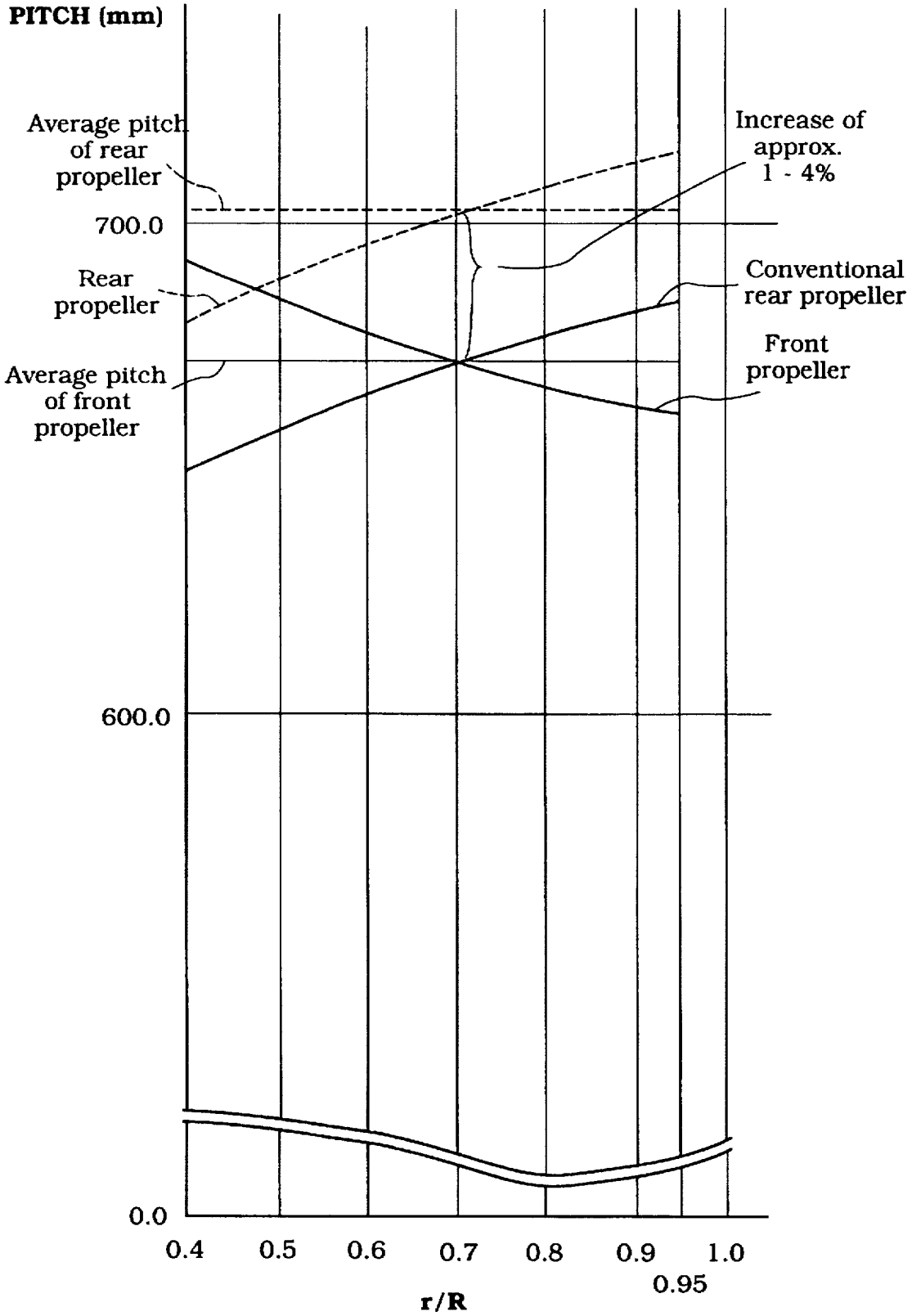
FIG. 6 is a graph of blade pitch variation along the blade length from a 4/10 radius to about the tip of the blade for both the front and rear propellers, as well as for a conventional rear propeller.

The curved sectional-shape of each blade 116, 128 along a pitch line of the front and rear propellers 58, 56 gives each blade varying pitch. Pitch is the distance that a propeller would theoretically move through a soft solid in one revolution. FIG. 6 illustrates the pitch at various radius r from the center of the propeller expressed as a fraction of the overall radius R (see FIG. 3). Both the pitches of the front and rear propellers 58, 56 are illustrated, as well as their average pitches over the entire blade. The pitch of a conventional rear propeller is also illustrated for comparison purposes.

In the illustrated embodiment, the average pitch of the rear propeller 56 (e.g., a little over 700 mm) is larger than the average pitch of the front propeller 58 (e.g., approximately 675 mm). The difference between the average pitches of the front and rear propellers 58, 56 desirably is within the range from about 5 mm to 25 mm. This represents about a 1% to about a 4% difference between the average pitches between the blades 116, 128 of the rear and front propellers 56, 58. As seen in FIG. 5, the pitch of the blade 116, 128 at the 7/10 radius generally equals the average pitch of the blade 116, 128.

The average pitch of the rear propeller 56, however, need not be larger than the average pitch of the front propeller 56. The front propeller 58 can have a larger average pitch than the rear propeller 56. A difference between the average pitches of the front and rear propellers 56, 58 should exist, however, with the difference being in the range from about 1% to about 4% of the smaller of the average pitches.

FIG. 6 also illustrates a pitch variation along the blade of a conventional rear propeller. As seen in FIG. 5, the front propeller 58 and the conventional rear propeller generally have the same average pitch. No difference exists. The slope of the line representing the progressive pitch of the conventional rear propeller also is the inverse of the slope of the line representing the pitch variation over the blade length of the front propeller 58. And the front propeller 58 and the conventional rear propeller have the same pitch at the 7/10 radius. As FIG. 5 illustrates, the pitch of the rear propeller 58 of the present propulsion device 12 is increased by about 1% to about 4% along the entire length of the propeller over that of the conventional rear propeller.

Figure 7:
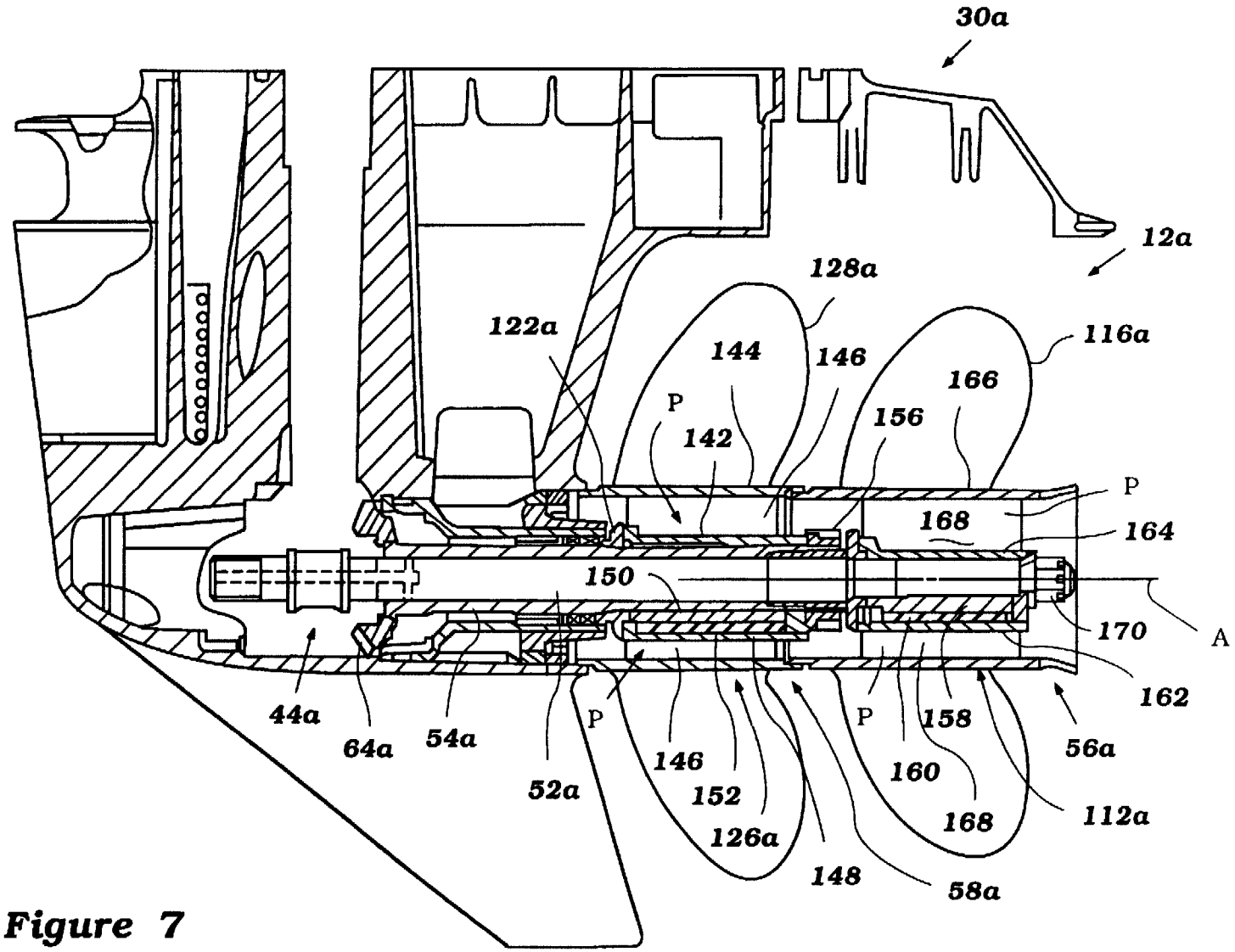
FIG. 7 is a sectional side elevational view of a lower unit and propulsion system of an outboard drive configured in accordance with another embodiment of the present invention, with the transmission and drive shaft being omitted for simplicity.

FIG. 7 illustrates another embodiment of the present propulsion device **12*a*. The propulsion device 12*a*** is substantially identical to that described above, except for the addition of exhaust passages P formed through the hubs 112a, 126a of the propellers 56a, 58a and the coupling between the propeller shafts 52a, 54a and the propeller hubs 112a, 126a. For this reason, the following description will focus only on the configuration of the propeller hubs 112a, 126a and their interconnection to the propeller shafts 52a, 54a. It is understood that the above description should apply equally to the embodiment of FIG. 7 unless indicated otherwise. In addition, like reference numbers with an "a" suffix have been used to indicate similar components of the two embodiments for ease of understanding.

With reference to FIG. 7, the front propeller boss or hub 126a includes an inner sleeve 142 and an outer sleeve 144 to which propeller blades 128 are integrally formed. A plurality of radial ribs 146 extend between the inner sleeve 142 and the outer sleeve 144 to support the outer sleeve 144 about the inner sleeve 142 and to form passages P through the propeller hub 126a. Engine exhaust is discharged through these passages P, as known in the art.

The inner sleeve 142 defines an asymmetric relief 148 in which an engagement member 150 and a rubber damper 152 are positioned. The engagement member 150 engages the rear end of the outer shaft 54a. The rubber damper 152 is compressed between the engagement member 150 and the inner side of the relief 148 formed by the inner sleeve 142. The frictional engagement between the engagement member 150, the rubber damper 152 and the inner sleeve 142 is sufficient to transfer rotational force from the engagement member 150 to the front propeller 58a.

A retaining nut 156 secures the front propeller 58 to the rear end of the outer shaft 54a. In the illustrated embodiment, the retainer nut 156 screws onto threads formed on the rear end of the outer propulsion shaft 54a. The nut 156 acts against the inner sleeve 142 to force the propeller hub 126a against the front trust washer 122a. As seen in FIG. 7, at least a portion of the retaining nut 156 extends beyond a rear end of the front propeller hub 126a.

The inner shaft 52a carries the rear propeller 56a in a similar manner. The rear end of the inner shaft 52a carries an engagement member 158 in driving engagement with the shaft 52a. A rubber damper 160 is compressed between the engagement member 158 and an inner surface of a relief 162 of an inner sleeve 164. The sleeve 164 forms the asymmetric relief 162 to capture the engagement member 158 and the rubber damper 160.

The inner sleeve 164 forms part of a hub or boss 112a of the rear propeller 56a. The propeller hub 112a also includes an outer sleeve 166 which encircles the inner sleeve 164. A plurality of radial ribs 168 extend between the inner sleeve 164 and the outer sleeve 166 to support the outer sleeve 166 about the inner sleeve 164 and to form passages P through the propeller hub 112a. These passages P communicate with the passages P formed in the propeller hub 126a of the front propeller 58a.

A nut 170 secures the propeller hub 112a of the rear propeller 56a to the end of the inner propulsion shaft 52a. The nut 170 forces the propeller hub 112a against a rear thrust washer 110a to transfer forward driving thrust to the inner propulsion shaft 52a. The rear thrust washer 110a lies directly behind the retaining nut 156.

In order to minimize the gap spacing between the front and rear propellers 56a, 58a, the outer sleeve 166 of the rear propeller hub 112a extends forward and overlaps with a rear end of the outer sleeve 144 of the front propeller 58a. The point of overlap desirably occurs forward of the rear end of the outer propulsion shaft 54a such that the front end of the rear propeller outer sleeve 166 circumscribes the retaining nut 156. In this position, the blades 116a of the rear propeller 56a lie near the blades 128a of the front propeller 58a.

Figure 8:
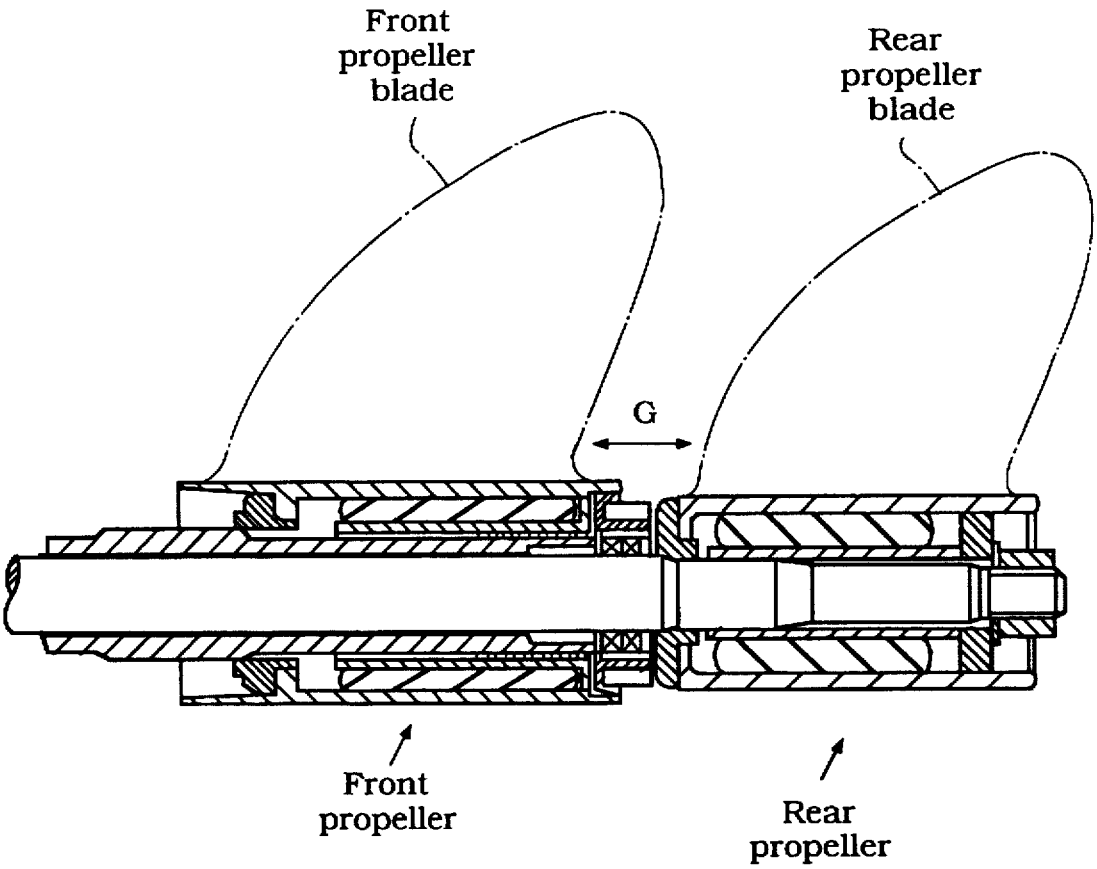
Figure 8 Prior Art
FIG. 8 is a partial sectional side elevational view of a prior propulsion system for an outboard drive.

In order to appreciate the reduced gap spacing provided by the propeller arrangements described above and illustrated in FIGS. 2 and 7, FIG. 8 is provided to illustrate a prior propeller arrangement. A significant gap G exists between the front and rear propellers. As noted above, this gap G previously was desired in order to space the rear propeller from the front propeller to reduce the effects of cavitations created by the front propeller. The illustrated propeller arrangement, with the hub of the rear propeller positioned entirely behind the retaining nut, was used to produce the desired gap spacing G between the front and rear propellers.

The design of the blades 116, 128 of the front and rear propellers 56, 58 of the present propulsion device 12, however, reduces cavitations. An anti-cavitation effect occurs with the propeller blades 116, 128 having constant-radius mean camber lines MCL and blade cambers C within the recited range. As a result, the spacing between the front and rear propellers 56, 58 can be reduced. The embodiments of FIGS. 2 and 7 illustrate propeller layouts with the desired reduced gap spacing.

The decrease in spacing between the rear propeller 56 and the steering axis of the outboard drive 10 reduces steering torque. As noted above, the rear propeller 56 produces a lateral force component as it re-enters the water when run partially surfaced. The resulting torque created by this lateral force, however, is lessened by moving the rear propeller 56 closer to the steering axis of the outboard motor 10. This of course improves the handling characteristics of the watercraft 16.

The more similar surface ratio between the front and rear propellers 56, 58 also enhances the handling characteristics of the watercraft 16, especially when turning. The enlargement of the rear propeller 56 over prior designs reduces slippage of the rear propeller 56. The watercraft possesses improved handling stability by minimizing propeller slip.

The anti-cavitation effect gained by the desired camber amount of the propeller blades 116, 128 of the front and rear propellers 56, 58 reduces chine walking. This effect, together with the tightened responsiveness gained by the introduction of a variance between the average pitches of the front and rear propellers 56, 58, further enhances the handling characteristics of the watercraft 16.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A propulsion device for a watercraft comprising a front propeller and a rear propeller intended to rotate in opposite directions about a common rotational axis, said front and rear propellers each including at least one blade and having a total blade face surface area, the total blade face surface area of said rear propeller being smaller than the total blade face surface area of said front propeller, but no smaller than about 70% of the total blade face surface area of the front propeller.

2. A propulsion device as in claim 1, wherein each blade of said front and rear propellers has a leading edge and a trailing edge with a blade face and a blade back extending between the leading and trailing edges on opposite sides of the propeller blade, the blade also having a mean camber line defined through a blade section taken along a pitch line of the blade, said mean camber line having an arcuate shape.

3. A propulsion device as in claim 2, wherein said mean camber line has a generally constant radius of curvature between the leading and trailing edges of the blade.

4. A propulsion device as in claim 2, wherein said mean camber line with a constant radius of curvature is formed at least along a pitch line taken a 7/10 radius of said blade.

5. A propulsion device as in claim 2, wherein a camber of said blade is approximately 0.5 to 3.5 percent of a width of the blade.

6. A propulsion device as in claim 1, wherein said front and rear propellers each include at least one blade that has an average pitch, the average pitches of the front and rear propellers differing from each other by an amount ranging from 1 to 4 percent of a smaller value of said average pitches.

7. A propulsion device as in claim 1, wherein a rake angle of each blade of said front and rear propellers is between about 15° and about 25°.

8. A propulsion device as in claim 7, wherein said rake angles of each blade of said front and rear propellers are substantially the same.

9. A propulsion device as in claim 1, wherein said front and rear propellers have the same number of blades.

10. A propulsion device as in claim 9, wherein said at least one blade of said rear propeller has the same but smaller exterior shape defined by leading and trailing edges as that of said front propeller.

11. A propulsion device as in claim 1 additionally comprising an inner propulsion shaft carrying said rear propeller and a hollow outer propulsion shaft carrying said front propeller.

12. A propeller device as in claim 11, wherein a retainer nut is connected to a rear end of said outer shaft to fasten said front propeller to the outer shaft, and at least a portion of said rear propeller overlaps at least a portion of said retainer nut a direction along the rotational axis.

13. A propeller device as in claim 12, wherein a front end of a hub of said rear propeller circumscribes at least a portion of said retainer nut.

14. A propulsion device for a watercraft comprising at least one propeller blade having a leading edge and a trailing edge with a blade face and a blade back extending between the leading and trailing edges on opposite sides of the propeller blade, said blade having a mean camber line defined through a blade section taken along a pitch line of the blade, said mean camber line having a generally constant radius of curvature between said leading and trailing edges of said blade.

15. A propulsion device as in claim 14, wherein said mean camber line with a constant radius of curvature is formed at least along a pitch line taken a 7/10 radius of said blade.

16. A propulsion device as in claim 14, wherein a camber amount of said blade is approximately 0.5 to 3.5 percent.

17. A propulsion device as in claim 16, wherein a maximum distance between the mean camber line and a chord line of the blade section occurs at a mid-point between the leading and trailing edges.

18. A propulsion device as in claim 14, wherein a rake angle of said blade is between about 15° and about 25°.

19. A propulsion device as in claim 18, wherein each blade extends from an outer hub of a front propeller.

20. A propulsion device as in claim 19, wherein said propeller includes an inner hub positioned within said outer hub to define an exhaust path through said propeller.

21. A propulsion device as in claim 19 additionally comprising a rear propeller, said propellers being intended to rotated in opposite directions about a common rotational axis.

22. A propulsion device for a watercraft comprising a front propeller and a rear propeller intended to rotate in opposite directions about a common rotational axis, said front and rear propellers each including at least one blade which includes an average pitch, the average pitches of the front and rear propellers differing from each other by not more than generally about 4 percent and the front and rear blades each having a total blade face surface area with the total blade face surface area of the rear blade being smaller than the total blade face surface area of the front propeller.

23. A propulsion device as in claim 22, wherein said average pitches of the front and rear propellers differ from each other by at least about 1 percent.

24. A propulsion device as in claim 23, wherein said average pitch of said rear propeller is larger than the average pitch of said front propeller.

25. A propulsion device as in claim 23, wherein said average pitch of said front propeller is larger than the average pitch of said rear propeller.

26. A propulsion device as in claim 22, wherein the total blade face surface area of said rear propeller is no smaller than about 70% of the total blade face surface area of the front propeller.

27. A propulsion device as in claim 22, wherein each blade of said front and rear propellers has a leading edge and a trailing edge with a blade face and a blade back extending between the leading and trailing edges on opposite sides of the propeller blade, the blade also having a mean camber line defined through a blade cutaway taken along a pitch line of the blade, said mean camber line having a generally constant radius of curvature.

28. A propulsion device as in claim 27, wherein said mean camber line with a constant radius of curvature is formed at least along a pitch line taken a 7/10 radius of said blade.

29. A propulsion device as in claim 27, wherein a camber of said blade is approximately 0.5 to 3.5 percent of a width of the blade.

30. A propulsion device as in claim 22, wherein each blade of said front and rear propellers extends from an outer hub in a rearward direction at an angle from a plane which is perpendicular to the rotational axis, said angle being within a range from about 15 degrees to about 25 degrees.

31. A propulsion device as in claim 22, additionally comprising an inner propulsion shaft carrying said rear propeller and a hollow outer propulsion shaft carrying said front propeller.

32. A propeller device as in claim 31, wherein a retainer nut is connected to a rear end of said outer shaft to fasten said front propeller to the outer shaft, and at least a portion of said rear propeller overlaps at least a portion of said retainer nut a direction along the rotational axis.

33. A propeller device as in claim 32, wherein a front end of a hub of said rear propeller circumscribes at least a portion of said retainer nut.

34. A propulsion device for a watercraft comprising at least one propeller blade having a leading edge and a trailing edge with a blade face and a blade back extending between the leading and trailing edges on opposite sides of the propeller blade, the blade having a width, which is defined between the leading and trailing edges, and a blade camber which is within the range of approximately 0.5 percent to approximately 3.5 percent of the width of the blade at least along a pitch line taken at about a 7/10 radius of the blade.

35. A propulsion device as in claim 34, wherein the blade has a mean camber line, which is defined through the blade section taken at about the 7/10 radius, with a generally constant radius of curvature between the leading and trailing edges of the blade.

36. A propulsion device as in claim 34, wherein a rake angle of the blade is between 15 degrees and 25 degrees.

37. A propulsion device as in claim 34 additionally comprising a second propeller positioned behind said at least one propeller, said propellers being arranged to rotate in opposite directions about a common rotational axis.

38. A propulsion device as in claim 37, wherein each propeller has a total blade face surface area, and the total blade face surface area of the second propeller is smaller than the total blade face surface area of said at least one propeller, but no smaller than about 70% of the total blade face surface area of said at least one propeller.

39. A propulsion device as in claim 37, wherein each propeller includes at least one blade that has an average pitch, the average pitches of the propellers differing from each other by an amount ranging from about 1% to about 4% of a smaller value of said average pitches.

* * * * *